United States Patent [19]

Stovall et al.

[11] 4,330,571

[45] May 18, 1982

[54] METHOD OF APPLYING CORROSION PREVENTIVE COATING TO METALLIC CABLE

[75] Inventors: Philip H. Stovall; Robert C. Webber, both of Marietta, Ga.

[73] Assignee: Lockheed Corporation, Burbank, Calif.

[21] Appl. No.: 169,885

[22] Filed: Jul. 17, 1980

Related U.S. Application Data

[63] Continuation of Ser. No. 973,097, Dec. 26, 1978, abandoned.

[51] Int. Cl.[3] ..... B05D 1/18; B05D 3/02; B05D 3/12; B05D 5/12

[52] U.S. Cl. ..... 427/120; 106/14.26; 106/14.41; 106/285; 252/388; 427/355; 427/388.5; 427/435

[58] Field of Search ..... 427/117, 120, 388.1, 427/435, 369, 355, 388.5; 106/285, 14.26, 14.41; 252/388

[56] References Cited

U.S. PATENT DOCUMENTS

| | | | |
|---|---|---|---|
| 2,899,391 | 8/1959 | Maghew et al. | 106/14.26 X |
| 2,978,098 | 4/1961 | Post | 427/435 X |
| 3,013,907 | 12/1961 | Baird et al. | 427/435 |
| 3,086,888 | 4/1963 | Stratton et al. | 427/435 X |
| 3,115,422 | 12/1963 | Thomson | 427/435 |
| 3,764,375 | 10/1973 | Orlando et al. | 427/120 |
| 4,096,291 | 6/1978 | Dunwald et al. | 427/120 |

*Primary Examiner*—Michael R. Lusignan
*Attorney, Agent, or Firm*—Albert L. Carter

[57] ABSTRACT

A method of applying substantially consistent and uniform coatings of a corrosion preventive compound to metallic cable lengths is disclosed which involves the immersion of the cable into a liquid coating compound of controlled viscosity followed by wiping the cable with a compound-containing material upon withdrawal of the cable from the compound.

4 Claims, No Drawings

METHOD OF APPLYING CORROSION PREVENTIVE COATING TO METALLIC CABLE

This application is a continuation, of application Ser. No. 973,097, filed Dec. 26, 1978, now abandoned.

This invention concerns the application of corrosion preventive coatings to metallic cables whereby the applied coating is substantially consistent and uniform along the cable length.

Experience has dictated that control cables formed of wires of steel, zinc coated steel, and tin coated steel should have a coating protection to avoid corrosive deterioration resulting from water (humidity) or gaseous atmospheres (carbon dioxide, sulfur dioxide, etc.). Such need for a corrosion protective coating exists notwithstanding a usual lubrication of the individual wires by cable manufacturers to keep the cable wires from fretting; such lubrication generally being applied whether the outer surface of the individual wires is steel, zinc or tin, etc.

The type of corrosion preventive coatings used on metallic cable members is typified by that defined in Military Specification MIL-C-16173 which covers solvent-dispersed corrosion preventive compounds which deposit thin films after evaporation of solvent which are in turn easily removable by subsequent use of solvent after application. This specification MIL-C-16173 further defines the compounds as composed of nonvolatile hydrocarbon material dispersed in petroleum solvent so as to form a fluid formulation that is homogeneous, free from grit, abrasives, water, chlorides or other impurities; that benzol or chlorinated hydrocarbons shall not be used in the compounds; and the compounds shall readily wet the surfaces of the material being coated with the resulting coating being continuous upon evaporation of the solvent.

Notwithstanding the readily market availability of coating compounds of various proprietary compositions qualified under Military Specification MIL-C-16173 from manufacturing suppliers as exemplified by compound 161-4 from Franklin Oil Corporation, Cleveland, Ohio, under their trade name "Rust Foil" and compound E. F. 1058 from Houghton Company, Philadelphia, Pennsylvania, under their trade name "Cosmoline", difficulties have been experienced in obtaining consistent and uniform coatings: i.e., problems where coatings were too light, too heavy or non-uniform. Whether the method of coating application was by painting, spraying, or the most prevalent one of cable immersion in and withdrawal from the compound, the placement of the coated cables in either vertical or horizontal orientations for drying of the solvent produces unsatisfactory results in numerous instances requiring a substantial amount of rework such as stripping and recoating. For example, vertical oriented cables result in draining causing a heavy accumulation of compound near the lower end, while horizontal oriented cables result in numerous drips and sags along the lower side. When these problems are attempted to be overcome by thinning the compound to a lower viscosity, the coating thickness is generally inadequate, inconsistent and non-uniform.

Accordingly, it is an object of this invention to provide a method of applying a corrosion preventive coating to metallic cable lengths whereby substantial consistency and uniformity of applied coatings may be attained.

Another object of this invention is to provide a method of corrosion preventive compound application to metallic cable lengths that is facile, inexpensive, and meets the quality goal of the above object regardless of the physical orientation of the coated cable for drying.

Further objects and advantages of this invention will become apparent from the following description.

Generally, stated, the invention is practiced by dipping or immerging a cable length to be coated into a corrosion preventive coating compound of the nature described above that is of specifically controlled viscosity and followed by the wiping of the cable length as it is withdrawn from the compound solution with a compound adsorbent material, such as a sponge, that surrounds the cable external of the compound solution with the wiping material at least wetted by the compound.

More specifically, this invention involves establishing the viscosity of the compound, at the temperature of application, to a level of from approximately 200 to approximately 250 centistokes (equivalent to a level of approximately 18 to approximately 22 seconds time drain from a No. 4 Zahn cup), followed by the immersion or dipping of the cable length therein. Such viscosity control is accomplished by either the appropriate addition of coating compound or evaporation of solvent to increase viscosity or addition of a hydrocarbon solvent such as naphtha, mineral spirits or Stoddards Solvent to reduce viscosity. Associated with this preceding described operation, a sponge or other appropriate wiping material is immersed in the compound solution, removed and with most of the compound squeezed out of it, is placed around the cable as it is withdrawn from the compound solution. The coating of the cable is then dried in any appropriate manner by evaporation of the compound solvent whereupon the coating process is complete.

It is immaterial whether the wiping contact with the coated cable length is hand or tool maintained, the primary feature being that through different wiper material-cable contact pressures, various thicknesses of coating can be obtained, and so long as the pressure is constant over the length of the cable, a substantially consistent and uniform coating thickness will result. Also, it is not considered material the timing of the wiper material immersion occurrence in the compound except that it should not precede the cable withdrawal from the compound by such an amount of time that the compound in the material is so dried by solvent evaporation that at least a slideable, wettable contact between the wiper material and cable cannot be maintained as the cable is withdrawn from the compound solution. Likewise, the wetted wiper material need not be maintained or established at or near the temperature of the coating compound being applied; i.e., it may be at or near the ambient temperature.

Through practice of this method it has been found that satisfactory and acceptable corrosion preventive coatings have been applied to metallic cable lengths having a high degree of coating consistency and uniformity without objectionable drainage accumulations, drips or sags resulting during the drying of the coating.

While particular embodiments of the invention have been described, it will be obvious to those skilled in the art that various changes and modifications may be made without departing from the invention, and it is intended to cover in the appended claims all such modifications and equivalents that fall within the true spirit and scope of this invention.

What is claimed is:

1. The method of applying a corrosion preventive coating to a metallic cable length comprising the steps of:

(a) immersing the cable in a solvent-dispersed corrosion preventive compound solution consisting of a nonvolatile hydrocarbon material dispersed in at least one petroleum solvent from the group of naphtha, mineral spirits and Stoddards Solvent to constitute a homogeneous fluid formation that is free from grit, abrasives, chlorides and other impurities, the solvent quantity being such to produce a solution viscosity of from approximately 200 to approximately 250 centistokes at the temperature and time of such cable immersion;

(b) withdrawing the cable from the solution followed thereafter by the wiping of the cable with a solution adsorbent material that is at least wetted by said solution;

(c) and, drying said cable applied coating by evaporation of solution solvents.

2. The method of claim 1 wherein the solution viscosity of step a) is approximately 225 centistokes.

3. The method of claim 1 wherein the solution absorbent material of step b) is a sponge.

4. The method of claim 1 wherein the wiping of the cable in step b) occurs at a substantially constant pressure throughout the length of the cable.

* * * * *